US005944413A

United States Patent [19]

Crookham et al.

[11] Patent Number: 5,944,413

[45] Date of Patent: Aug. 31, 1999

[54] APPARATUS AND METHOD FOR MOVEABLE LIGHTING

[75] Inventors: David M. Crookham; James A. Whitson, both of Oskaloosa, Iowa

[73] Assignee: Musco Corporation, Oskaloosa, Iowa

[21] Appl. No.: 08/853,173

[22] Filed: May 8, 1997

[51] Int. Cl.[6] ..... F21S 1/10

[52] U.S. Cl. ..... 362/431; 362/250; 362/233

[58] Field of Search ..... 362/431, 414, 362/233, 250, 265

[56] References Cited

U.S. PATENT DOCUMENTS

| | | | |
|---|---|---|---|
| 4,228,489 | 10/1980 | Martin | 362/414 |
| 4,319,311 | 3/1982 | Mitchell | 362/250 |
| 4,423,471 | 12/1983 | Gordin et al. . | |
| 4,450,507 | 5/1984 | Gordin et al. . | |
| 4,712,167 | 12/1987 | Gordin et al. | 362/233 |
| 5,207,747 | 5/1993 | Gordin et al. . | |
| 5,337,221 | 8/1994 | Gordin et al. . | |
| 5,398,478 | 3/1995 | Gordin et al. . | |
| 5,623,786 | 4/1997 | DeMeyer | 52/6 |
| 5,757,597 | 5/1998 | Frank, Sr. | 362/431 |

*Primary Examiner*—Sandra O'Shea
*Assistant Examiner*—Todd Reed Hopper
*Attorney, Agent, or Firm*—Zarley, McKee, Thomte, Voorhees & Sease

[57] ABSTRACT

An apparatus and method for moveable lighting of large areas includes moveable bases upon which can be mounted light poles and light fixtures that elevate lights to a substantially high level. Each base has a size and mass that allows the pole and light fixture(s) to freely stand, including against normal environmental conditions without tipping. The base can be moved from location to location and transported with conventional equipment eliminating dedicated trailers or trucks and eliminating a substantial labor and time to erect portable tower.

28 Claims, 1 Drawing Sheet

APPARATUS AND METHOD FOR MOVEABLE LIGHTING

INCORPORATION BY REFERENCE

The contents of the following commonly owned issued U.S. patents, including written description and drawings, are incorporated by reference herein: U.S. Pat. No. 4,712,167 issued Dec. 8, 1987; U.S. Pat. No. 5,207,747 issued May 4, 1993; U.S. Pat. No. 5,337,221 issued Aug. 9, 1994; and U.S. Pat. No. 5,398,478 issued Mar. 21, 1995.

BACKGROUND OF THE INVENTION

1. Field of the Invention

The present invention relates to an apparatus and method for moveable lighting of relatively large areas, and more particularly, lighting that is portable in the sense that it can be transported from site to site and assembled, moved, and disassembled at each site with permanent anchoring or construction in the ground.

2. Problems in the Art

There are many examples of situations where temporary lighting on a large scale is needed or desired. A primary example is construction projects. Night time work is many times desirable because it reduces conflict with day time events such as traffic and normal daytime operations. The expense of construction and maintenance operations also dictates a cost efficiency in having around-the-clock availability to the work site.

Many times the installation of permanent lighting is not feasible or practical. For example, after a construction or maintenance is completed, lighting may not be necessary. It could even be obstructive.

A specific example of the need for temporary lighting involves roadway or highway construction projects. Traffic is usually reduced during the nighttime hours making it easier for construction vehicles and personnel to move about the construction site and increasing safety for the workers. It also allows a more full-scale occupation of the construction site which would otherwise block or slow down traffic.

Conventional ways of lighting such sites would be either the installation of permanent or semi-permanent lighting on light poles that would elevate lighting fixtures to light a wide area, or temporary lighting systems. The temporary lighting systems tend to involve self-powered lighting fixtures on trailers. The fixtures are suspended several feet in the air, and are fairly easily moveable from location to location. Other types of temporary lighting include towers that are used to elevate light fixtures. The towers may elevate the lights higher than the portable trailers, but still they rarely exceed twenty-five feet in height. Trailer based systems also do not generally exceed twenty-five feet in height. Trucks with extendible lights such as disclosed in U.S. Pat. Nos. 4,712,167 and 5,207,747 are too expensive and not practical for such uses.

The problems and deficiencies with the state of the art include the following. The several feet in height portable trailer based systems limit the area that can be lighted because of the low level the lights can be elevated. Although quick to assemble and move, they lack the ability to light large areas and also can cause glare because of their relatively shallow projection of light, which presents problems both for workers and traffic. Towers, on the other hand, might elevate lights somewhat higher for larger coverage, but require a significant amount of labor, time and resources to construct. The same is true to disassemble them and move them to a new location. They still are not to a sufficient height that they can flexibly light large areas, like permanent light poles, and thus still present glare and safety problems because of the angle of light that they project.

Both the trailer based systems and the temporary towers are also relatively expensive because of the need for them to be transported and quickly moved from location to location. Neither of these systems is that easy to transport. Each trailer requires a separate vehicle to move them from place to place. The towers must be assembled and disassembled by pieces. Also the flexibility with regard to these types systems is limited.

It is therefore a primary object of the present invention to provide an apparatus and method for moveable lighting which improves over or solves the problems and deficiencies in the art.

Other objects, features, and advantages of the present invention are as follows:

a. relatively high elevation of lights so that one light or an array of lights can illuminate a larger area with diminished glare and safety problems;

b. relative ease in changing the locations of the lights;

c. a minimum amount of assembly;

d. convenient transportation and storage; and e. flexibility in the control of lighting of the area to be lighted, including remote control of aiming and beam characteristics.

These and other objects, features, and advantages of the present invention will become more apparent with reference to the accompanying specification and claims.

SUMMARY OF THE INVENTION

The present invention includes an apparatus for relatively portable, moveable lighting. As base includes a ground contacting foot. A receiver in the base is configured to receive a light pole upon which are fixed one or more light fixtures. The base is transportable and moveable from location to location. The light pole is a height correlated to the base so that the base can maintain the light pole free-standing so that it can elevate the light fixture or fixtures to a relatively substantially high position.

The method according to the invention includes correlating the size and mass of the base to the height size weight of the light pole and fixtures. The base is transported and moved to a location relative to the area to be lighted. The light pole with the fixtures is moved to the base. The light pole is then raised and removably mounted onto the base so that the light pole is in a upright position.

DETAILED DESCRIPTION OF EMBODIMENT

Figure 1:
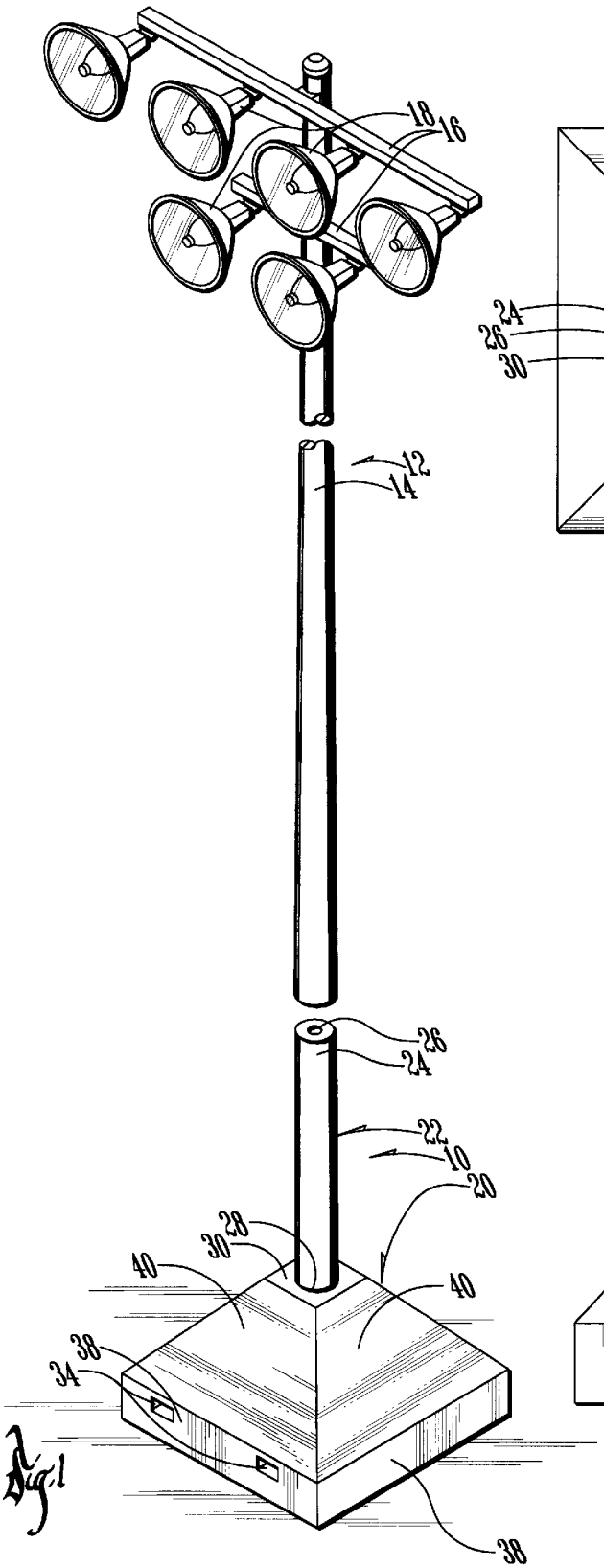
FIG. 1 is a perspective view of a preferred embodiment of the invention including, in exploded form, a light pole and light fixtures relative to a moveable base on the ground.

To assist in the understanding of the invention, a preferred embodiment will now be described in detail. Frequent reference will be taken to the drawings. Reference numerals are used to indicate certain parts and locations in the drawings. The same reference numerals will refer to the same parts and locations throughout all the drawings unless otherwise indicated.

FIG. 1 illustrates a base 10. Base 10 includes a lower portion or foot 20. Foot 20 includes a bottom surface 32 which will be generally referred to as the ground-contacting surface of base 10. A top surface 30 has extending from it a stub 22.

As shown in FIG. 1, stub 22 is configured to receive the hollow lower end of a light pole and fixtures (designated generally at 12). The pole 14 slip fits down upon stub 22 a certain distance. Cross-arms 16 are secured to pole 14 and in turn have mounted thereon a plurality of light fixtures 18.

Figure 2:
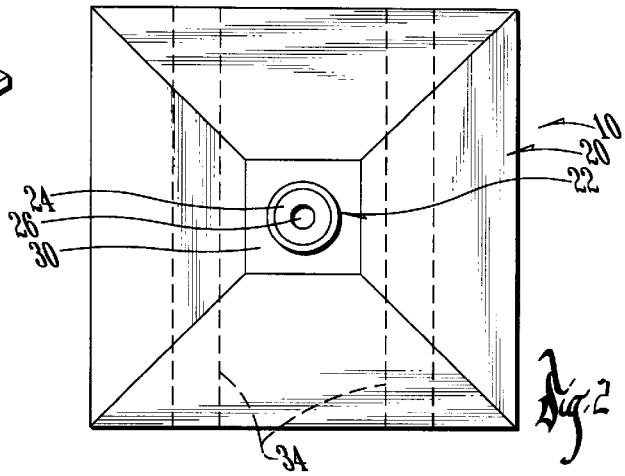
FIG. 2 is a top-plan view of the base of FIG. 2.
Figure 3:
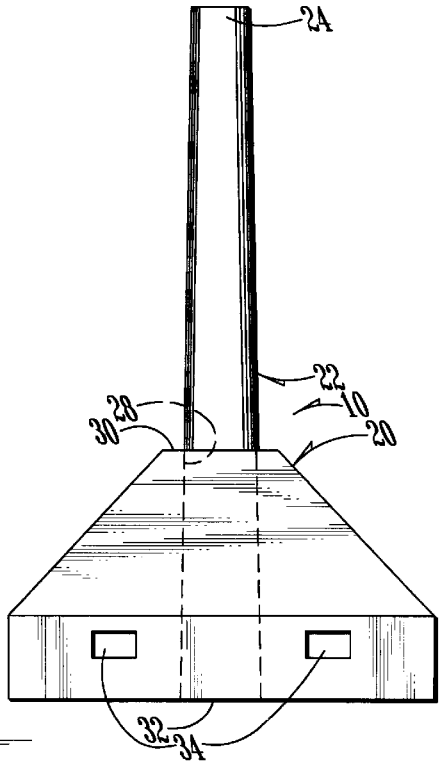
FIG. 3 is an elevational view of the base of FIG. 1.

FIG. 1 shows in exploded view that base 10 would receive a light pole 14 on stub 22. Once installed, base 10 supports pole and fixture combination 12 in a free standing manner. Therefore, when assembled, base 10 and combination 12 provide lighting that can elevate fixtures 18 to a relatively high location, but the entire device is relocatable. Thus, the benefits of both having a moveable, relocatable lighting device as well having the fixtures 18 elevated to a relative high height is accomplished. In the preferred embodiment of FIG. 1, stub 22 has a channel 26 running therethrough. As shown in FIGS. 2 and 3, specifics regarding base 10 can be seen. Stub 22 actually extends all the way through foot 20 in a mating channel indicated at 28 in FIG. 1. Stub 22 can be secured to foot 20 any number of ways well within the skill of those skilled in the art. One example is to simply pour sand between stub 22 and channel 26. Another is to pour concrete between so that the final product is essentially unitary.

Foot 20 also includes openings 34 which in this example are sized and spaced to receive standard tines of a conventional forklift. Openings 34 can be for example 3 ¾" by 6 ⅝" through-holes spaced approximately 30 inches apart.

Base 10 can be made of concrete. Other materials are possible. Base 10 is of a certain size and mass so that it is correlated with the size, weight, and height of pole 14, as well as the size and weight and other loading characteristics of cross-bars 16 and fixtures 18, so that combination 12 when installed on base 10 is free-standing. Also, the base 10 is configured and designed so that forces such as wind and other foreseeable forces against base 10 and/or combination 12 will not cause the entire device to tip over.

A specific example of a combination of the entire device will now be set forth. Base 10 is made of concrete. Bottom 32 is 60" a side or 3600 sq. inches in area. Vertical side-walls 38 are 12" tall. The inwardly slopping side-walls 40 extend up to top surface 30. Top surface 30 is 36" in height from bottom surface 32 or 24" in height from the junction of vertical wall 38 and slopped walls 40.

The distance between bottom surface 32 and the top surface 24 of stub 22 is 101". Stub 22 is 8 ¼" in diameter at top 24, but tapers slightly at least a portion of its length.

Openings 34 have top edges which are 2 ½" below the junction of sides 38 and 40, are 12 ¼" inset from corners of foot 20 and have adjacent inner edges 34 ½ apart.

Top surface 30 is approximately 20" square per side. The type of concrete used with base 10 is high tension concrete. In one example, the concrete is approximately 5000 psi. Other concrete types and characteristics are possible. This results in base 10, as an example, weighing approximately 6500 pounds.

It is to be understood that a wide variety of poles 14, cross-arms 16, and light fixtures 18 could be used with the base just previously described. However, one example is a hollow, tapered steel pole 14 having a length of approximately 40 feet. At the top of the pole is an integrated pole-top and cross-arm assembly. Such a pole-top could be similar to that shown in co-owned, issued U.S. patent Des. 337,168 issued Jul. 6, 1993. Alternatively, it could be a cross-arm assembly similar to that shown in co-owned, issued patent Des. 353,911 issued Dec. 27, 1994. Other cross-arms or light fixture supporting components could be used as is well know in the art.

The type of light fixtures 18 that could be used are high-intensity lamps with bowl-shaped reflectors such as are in common use in sports lighting. The lamps could be metal halide available from a variety of manufacturers including Philips. An example is a 1500 watt metal halide lamp. Another is a 1000 watt metal halide lamp. HMI lamps are also possible, as are many other types and characteristics. The reflectors can be made of aluminum roughly 30 inches in diameter and being of bowl-shaped, parabolic or elliptical or a combination thereof in cross section to produce control-concentrated beams of light. By utilizing several fixtures 18, composite light of an area, even a substantial distance away, with a relatively high illumination level is possible. At the height of such a pole, the lighting fixtures 18 would not necessarily have the propensity to cause as much glare and thus many times would be safer when in use.

Reference can be taken to U.S. Pat. No. 4,398,478 incorporated by reference herein, regarding the types of poles 14 and the way in which they could be slip fit and seated upon stub 22. As disclosed in that patent, a crane or other mechanism could grasp pole 14, lift it, and set it down on stub 22. The lights 18 would be pre-installed and could even be pre-aimed. If necessary, before seating pole 14 on stub 22, pole 14 could be rotated to rotate the lights in desired direction. When disassembly is required, the crane could simply grab pole 14 and lift it off of stub 22. No hardware or lock-down structures that are required. The weight of pole 14 and cross-arm 16 and fixtures 18 would provide sufficient downward force, along with the seating of pole 14 on stub 22, to retain it in place for use. Guy wires or cables between combination 12 and the ground or other structures could be used if needed, for example to tether the device against a strong wind or storm. A guy wire could be permanently attached to the pole and available at once if a high wind or storm arose.

Therefore, there is no requirement of piece by piece erection of this lighting system other than simply seating pole 14 on base 10.

If different components are required or desired for a certain lighting application, those skilled in the art would be able to figure out the size and weight and other characteristics of base 10 to support such a pole and lighting combination 12 as is desired.

Another subtle advantage of the present invention is the fact that it can be relatively easily assembled, disassembled, and transported. In the example given above, a forklift could be used to move bases 10 and/or combination 12 to desired locations. Each base simply would need to be placed on the ground at the desired location. Its size and mass would provide a stable foot and support for the pole. As described above, a crane or other mechanism that could grasp, turn upright, and then raise the bottom end of pole 14 sufficiently to slip fit down on stub 22 is all that is required to complete assembly, other than completing wiring of the fixtures 18 to an electrical power source, which is within the skill of those skilled in the art. FIG. 1 illustrates that ballast boxes and/or controls for the electrical circuitry to operate the light fixtures could optionally be fixed to base 10, so that such things as ballasts (if needed, on/off controls, fuses, and the like would be mounted and available.

When the lighting system needs to be moved relatively shorter distances, in many or most cases the forklift could grab base 10 with combination 12 mounted on it and move the entire system. Otherwise, one would first remove combination 12 from the base, move base 10 to the next location and then reinsert combination 12 onto the base. Their are machines known as super forklifts that could both lift base 10 with or without combination 12 attached to base 10, as well as grasp and lift combination 12 to mount it on base 10 or remove it from base 10.

With regard to transportation, in this example none of the poles 14 would exceed the length of a convention semi-trailer trailer. On the other hand, pole 14 could be made in succeeding sections as described in U.S. Pat. No. 5,398,478. Cross-arms 16 and fixtures 18 are generally of a size that they could be transported in a conventional semi-trailer, including in assembled form so that another step of assembly at the site is avoided.

Bases 10 would also be of a size that they could be transported by conventional transportation equipment. The base previously described and shown in the drawings could be transported on a flat-bed trailer, four or five to a trailer. The height of base 10, including the stub, would not exceed acceptable limits, usually 13'6".

Therefore, one or a collection of bases 10 and combinations 12 could be transported by conventional transportation equipment from site to site. In the interim the transportation equipment could be used for other uses. Convention equipment such forklifts and cranes that are common for construction and maintenance purposes, are used to assemble, move, and disassemble the systems. Thus, the handling of these parts is highly automated and minimizes the amount of manual labor and assembly and disassembly time that other prior art systems might require, while at the same use common equipment that can be used for other uses, instead of dedicated trailers or equipment that is needed for some prior art systems.

It will be appreciated that the present system can take many forms and embodiments. The true essence and spirit of this invention are defined in the appended claims and it is not intended that the embodiment of the invention presented herein should limit the scope thereof.

For example, as mentioned before, a variety of different configured bases 10 are possible including the use of a hole or aperture instead of a stub in which a pole 14 could be placed. Other mounting arrangements of pole 14 to base 10 are with the contemplation of the invention.

Furthermore, different types and sizes and configuration of poles, light fixtures, and components supporting the light fixtures on the pole can be utilized and come within the contemplation of the present invention. An example of the type of pole, cross arms and light fixtures are products sold by the owner of this application under the product designation LIGHT STRUCTURE (™).

Heretofore, the prior art utilized relatively low structures to elevate lights for temporary lighting purposes of relatively large areas. The flexibility and coverage as well as safety of lights elevated much higher is believed to be a very beneficial goal for temporary or moveable lighting. It is difficult to provide such high elevation on a temporary basis without expending substantial resources to build up a tower and the take it down to move it or put in permanent or semi-permanent poles, which would require digging holes and fixing the poles in the ground. The present invention solves these problems by using a large, weighty base to support a tall pole to elevate the lights accordingly. However, the base and pole can be moved relatively easily and assembled and disassembled relatively easily compared to those systems that have a larger number of parts.

Another option or feature that could be used with the innovation is as follows. There are many times where control of the placement and type of lighting issuing from light fixtures would be beneficial for temporary or moveable lighting purposes. According to the present invention, fixtures 18 could include actuators that would allow remote control panning and tilting of fixtures 18. Furthermore, remote control beam-spread between spot and spread beam could also be advantageous. Examples of a structures and control circuitry needed to do so are set forth in U.S. Pat. Nos. 4,712,167 and 5,207,747, both incorporated by reference herein. Other remote control features could be possible, such as tilting or panning of an entire array of lights.

Different types of fixtures other than shown in the drawings could also be used. An example is set forth at U.S. Pat. No. 5,337,221, incorporated by reference herein, which utilizes a primary reflector and a secondary reflector to control the beam output.

Wiring for the lights could pass through the center of base 10 and then through pole 14 and cross arms 16 into light fixtures 18. Other wiring arrangements are also possible, including sending wiring from ballast boxes 31 in FIG. 1 into an opening in the side of pole 14 and up to lights 18, or simply sending wires outside of pole 14 to lights 18.

In the preferred embodiment, base 10 has a size, configuration and weight to support a pole 14 of 60 foot in height and up to eight light fixtures of the type shown in FIG. 1. Taller and shorter poles and different numbers of light fixtures are possible. Base 10 could be adjusted in size, including the size of its "foot print", configuration and weight. Included in such considerations would be the height of stub 22. Generally it is contemplated that devices according to the invention would elevate light fixtures between 35 feet and 100 feet in the air. A family of bases 10 could be created and available depending on the pole height and number of fixtures.

What is claimed:

1. An apparatus for moveable lighting of relatively large areas comprising:

a base having a bottom surface placable on the ground and a top surface having a receiver;

a light pole at least twenty feet in length having a lower end that can be removably mated with the receiver of the base and an upper portion that supports one or more light fixtures;

the base and light pole being separable from each other for repositioning of the apparatus and for transporting.

2. The apparatus of claim 1 wherein the receiver and lower end of the light pole are matable, one as a male member and the other as a female member.

3. The apparatus of claim 1 wherein the receiver comprises an upwardly extending member.

4. The apparatus of claim 3 wherein the upwardly extended member is tapered.

5. The apparatus of claim 3 wherein the light pole has a hollow lower end matably fitable over the receiver.

6. The apparatus of claim 5 wherein the hollow lower end is tapered.

7. The apparatus of claim 1 wherein the receiver comprises an opening in the base.

8. The apparatus of claim 7 wherein the lower end of the light pole is insertable into the opening in the base.

9. The apparatus of claim 1 wherein the light pole is made of steel.

10. The apparatus of claim 1 wherein the light fixtures are mounted on a cross-arm assembly that is attached to the light pole.

11. The apparatus of claim 10 further comprising adjustable mounts between the cross-arm assembly and the fixtures.

12. The apparatus of claim 11 wherein the adjustable mounts include joints to allow aiming of the light fixtures in a plurality of directions.

13. The apparatus of claim 1 further comprising actuators which can alter aiming direction of the light fixtures by remote control.

14. The apparatus of claim 1 further comprising actuators which can alter the beam shape of the light fixtures by remote control.

15. The apparatus of claim 1 wherein the light fixtures include reflectors and high-intensity lamps.

16. The apparatus of claim 15 wherein the high-intensity lamps on the order of or greater than 1000 watts.

17. The apparatus of claim 1 including attachment members on the base, the attachment members allowing the base to be releasably engaged by a motive device to move the base from location to location.

18. The apparatus of claim 17 wherein the attachment members comprise openings in the base.

19. The apparatus of claim 18 wherein the openings are sized and spaced so that conventional forklift tines are insertable therein.

20. The apparatus of claim 17 wherein the attachment members comprise brackets.

21. The apparatus of claim 17 wherein the base has a height less than 13'6".

22. The apparatus of claim 1 wherein the base is made of concrete.

23. The apparatus of claim 1 wherein the base is approximately 60" square at its ground contacting surface and weighs several tons to support a light pole with no more than six light fixtures elevated at approximately 35 feet and higher.

24. A moveable base for supporting a light pole elevating one or more light fixtures comprising:

a ground contacting foot, the foot including an aperture;

a stub extending through the aperture from at or near the bottom of the foot out the top of the foot over six feet above the ground;

a receiver for the lower end of a light pole;

the base being moveable from location to location.

25. The base of claim 24 wherein the receiver comprises an upwardly extending stub.

26. The base of claim 24 wherein the receiver comprises an opening.

27. The base of claim 24 wherein the foot is configured to rest on top of the ground.

28. The base of claim 24 further comprising attachment members, the attachment members allowing the base to be releasably engaged by a motive device to move the base from location to location.

* * * * *